US009194625B2

(12) United States Patent
Herman et al.

(10) Patent No.: US 9,194,625 B2
(45) **Date of Patent: *Nov. 24, 2015**

(54) METHOD FOR DRYING ARTICLES

(71) Applicant: Whirlpool Corporation, Benton Harbor, MI (US)

(72) Inventors: Mark L. Herman, Saint Joseph, MI (US); Wallace S. Hubbard, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 165 days.

This patent is subject to a terminal disclaimer.

(21) Appl. No.: 13/970,938

(22) Filed: Aug. 20, 2013

(65) Prior Publication Data

US 2015/0052774 A1 Feb. 26, 2015

(51) Int. Cl.

| | |
|---|---|
| ***D06F 58/20*** | (2006.01) |
| ***F26B 3/34*** | (2006.01) |
| ***D06F 58/28*** | (2006.01) |
| ***F26B 3/347*** | (2006.01) |
| ***F26B 11/04*** | (2006.01) |
| ***D06F 58/26*** | (2006.01) |

(52) U.S. Cl.

CPC ..... *F26B 3/34* (2013.01); *D06F 58/266* (2013.01); *D06F 58/28* (2013.01); *F26B 3/347* (2013.01); *F26B 11/0477* (2013.01); *D06F 58/203* (2013.01); *D06F 2058/2854* (2013.01); *D06F 2058/2858* (2013.01)

(58) Field of Classification Search

CPC ..... F26B 3/00; F26B 3/34; F26B 3/347; D06F 58/00; D06F 58/20; H05B 6/54; H05B 6/00; H05B 6/62

USPC ..... 34/381, 595, 413, 601; 68/19, 20; 8/149, 159

See application file for complete search history.

(56) References Cited

U.S. PATENT DOCUMENTS

| | | | | |
|---|---|---|---|---|
| 4,250,628 | A * | 2/1981 | Smith et al. | 34/260 |
| 4,519,145 | A | 5/1985 | Mandel | |
| 5,396,715 | A | 3/1995 | Smith | |
| 5,659,972 | A * | 8/1997 | Min et al. | 34/255 |
| 6,098,306 | A * | 8/2000 | Ramsey et al. | 34/257 |
| 6,166,551 | A * | 12/2000 | Scott et al. | 324/637 |
| 7,665,226 | B2 * | 2/2010 | Tsuruta et al. | 34/259 |
| 7,676,953 | B2 * | 3/2010 | Magill | 34/282 |
| 7,941,937 | B2 * | 5/2011 | Do | 34/381 |
| 8,250,777 | B2 * | 8/2012 | Kim et al. | 34/595 |

(Continued)

FOREIGN PATENT DOCUMENTS

| | | | |
|---|---|---|---|
| DE | 4411838 | A1 | 10/1995 |
| GB | 1470719 | A * | 4/1977 |

(Continued)

OTHER PUBLICATIONS

European Search Report for Counterpart EP14179206.9, dated Jun. 18, 2015.

*Primary Examiner* — Stephen M Gravini

(57) ABSTRACT

An improved method of drying operation for an article using a field of electromagnetic radiation (e-field) generated between an anode element and a cathode element by a radio frequency (RF) applicator between the anode and cathode elements such that liquid in the article will be heated to effect a drying of the article.

9 Claims, 7 Drawing Sheets

(56) References Cited

U.S. PATENT DOCUMENTS

| | | | | |
|---|---|---|---|---|
| 8,683,713 | B2 * | 4/2014 | Ha et al. | 34/381 |
| 8,943,705 | B2 * | 2/2015 | Wisherd et al. | 34/255 |
| 2007/0215608 | A1 | 9/2007 | Yoshino et al. | |
| 2010/0115785 | A1 | 5/2010 | Ben-Shmuel et al. | |
| 2011/0251807 | A1 * | 10/2011 | Rada et al. | 702/61 |
| 2012/0291304 | A1 * | 11/2012 | Wisherd et al. | 34/255 |
| 2015/0020403 | A1 * | 1/2015 | Herman et al. | 34/255 |
| 2015/0052774 | A1 * | 2/2015 | Herman et al. | 34/255 |

FOREIGN PATENT DOCUMENTS

| | | | |
|---|---|---|---|
| JP | 6272866 | A | 9/1994 |
| JP | 10110955 | A | 4/1998 |
| WO | WO 00/69780 | * | 11/2000 |
| WO | 0166850 | A1 | 9/2001 |
| WO | 2005010270 | A1 | 2/2005 |

* cited by examiner

METHOD FOR DRYING ARTICLES

BACKGROUND OF THE INVENTION

Dielectric heating may be the process in which a high-frequency alternating electric field heats a dielectric material, such as water molecules. At higher frequencies, this heating may be caused by molecular dipole rotation within the dielectric material, while at lower frequencies in conductive fluids, other mechanisms such as ion-drag are more important in generating thermal energy.

Microwave frequencies are typically applied for cooking food items and are considered undesirable for drying laundry articles because of the possible temporary runaway thermal effects random application of the waves in a traditional microwave. Radio frequencies and their corresponding controlled and contained e-field are typically used for drying of textile material.

When applying an RF electronic field (e-field) to a wet article, such as a clothing material, the e-field may cause the water molecules within the e-field to dielectrically heat, generating thermal energy which effects the rapid drying of the articles.

BRIEF DESCRIPTION OF THE INVENTION

One aspect of the invention is directed to an improved method of drying operation for an article using a field of electromagnetic radiation (e-field) generated between an anode element and a cathode element by a radio frequency (RF) applicator within a radio frequency spectrum between the anode and cathode elements such that liquid in the article will be dielectrically heated to effect a drying of the article. The improvement includes dispensing water to the article in controlled amounts while the drying operation is occurring to effectively match the impedance between the article and the RF applicator.

In another aspect of the invention, a laundry drying appliance for drying an article, includes a support element for supporting the article to be dried, an anode element capacitively coupled with a cathode element and positioned relative to the support element to create a field of electromagnetic radiation (e-field) on the support element, a radio frequency (RF) applicator coupled with the anode element and the cathode element and operable to energize the anode element and the cathode element to generate an e-field in the radio frequency spectrum operable to dielectrically heat liquid within the article on the support element, a water dispensing apparatus coupled with a water source, and a controller configured to operate the water dispensing apparatus by dispensing water from the water source to the article in controlled amounts to effectively match the impedance of the article to the impedance of the RF applicator while the e-field is generated.

DESCRIPTION OF EMBODIMENTS OF THE INVENTION

While this description may be primarily directed toward a laundry drying machine, the invention may be applicable in any environment using a radio frequency (RF) signal application to dehydrate any wet article.

Figure 1:
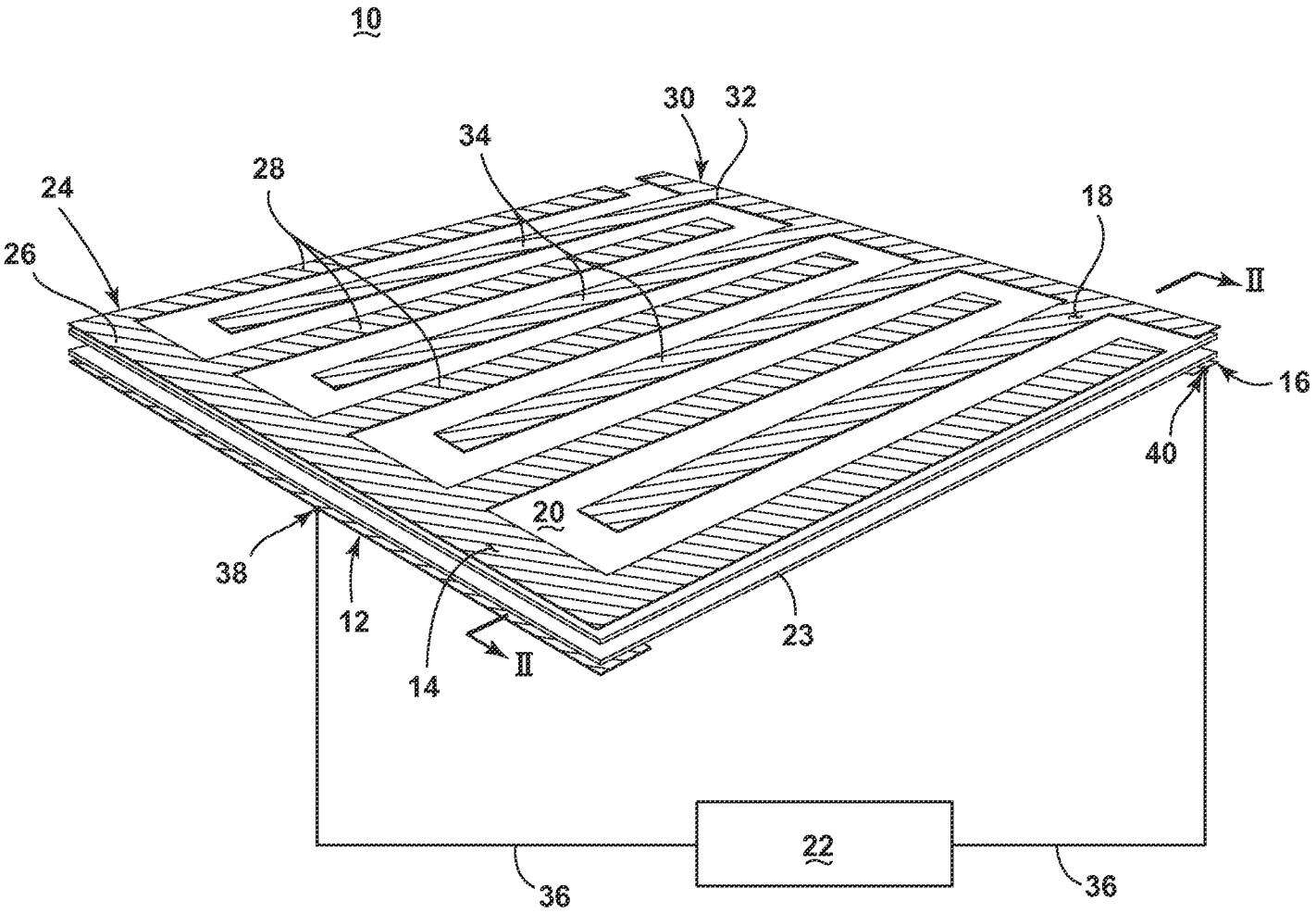
FIG. 1 is a schematic perspective view of the laundry drying appliance in accordance with the first embodiment of the invention.

FIG. 1 is a schematic illustration of a laundry drying appliance 10 according to the first embodiment of the invention for dehydrating one or more articles, such as articles of clothing. As illustrated in FIG. 1, the laundry drying appliance 10 has a structure that includes conductive elements, such as a first cathode element 12 and a second cathode element 14, and an opposing first anode element 16, a second anode element 18, in addition to a first non-conductive laundry support element 20, an optional second non-conductive support element 23, and an RF applicator 22. Alternative placement of the optional second non-conductive support element 23 is envisioned, such as placement below the first cathode and first anode elements 12, 16.

The second cathode element 14 further includes a first comb element 24 having a first base 26 from which extend a first plurality of teeth 28, and the second anode element 18 includes a second comb element 30 having a second base 32 from which extend a second plurality of teeth 34. The second cathode and second anode elements 14, 18 are fixedly mounted to the first supporting element 20 in such a way as to interdigitally arrange the first and second pluralities of teeth 28, 34. The second cathode and second anode elements 14, 18 may be fixedly mounted to the first support element 20 by, for example, adhesion, fastener connections, or laminated layers. Additionally, the first cathode and anode elements 12, 16 are shown fixedly mounted to the second support element 23 by similar mountings. Alternative mounting techniques may be employed.

At least a portion of either the first or second support elements 20, 23 separates an at least partially aligned first cathode and second cathode elements 12, 14. As illustrated, the elongated first cathode element 12 aligns with the substantially rectangular first base 26 portion of the second cathode element 14, through the first support element 20 and second support element 23, with the support elements 20, 23 separated by an optional air gap 70. Similarly shown, the elongated first anode element 16 at least partially aligns with the substantially rectangular second base 32 portion of the second anode element 18 through a portion of the first support element 20 and second support element 23, with the support elements 20, 23 separated by an air gap 70. The aligned portions of the first and second cathode elements 12, 14 are oppositely spaced, on the supporting elements 20, 23, from the aligned portion of the first and second anode elements 16, 18.

The RF applicator 22 may be configured to generate a field of electromagnetic radiation (e-field) within the radio frequency spectrum between outputs electrodes and may be electrically coupled between the first cathode element 12 and the first anode element 16 by conductors 36 connected to at least one respective first anode and cathode contact point 38, 40. One such example of an RF signal generated by the RF applicator 22 may be 13.56 MHz. The generation of another RF signal, or varying RF signals, may be envisioned.

Microwave frequencies are typically applied for cooking food items. However, their high frequency and resulting greater dielectric heating effect make microwave frequencies undesirable for drying laundry articles. Radio frequencies and their corresponding lower dielectric heating effect are typically used for drying of textiles, such as laundry. In contrast with a conventional microwave heating appliance, where microwaves generated by a magnetron are directed into a resonant cavity by a waveguide, the RF applicator 22 induces a controlled electromagnetic field between the cathode and anode elements 12, 14, 16, 18. Stray-field or through-field electromagnetic heating provides a relatively deterministic application of power as opposed to conventional microwave heating technologies where the microwave energy may be randomly distributed (by way of a stirrer and/or rotation of the load). Consequently, conventional microwave technologies may result in thermal runaway effects or arcing that are not easily mitigated when applied to certain loads (such as metal zippers etc.). Stated another way, using a water analogy where water may be analogous to the electromagnetic radiation, a microwave acts as a sprinkler while the above-described RF applicator 22 may be a wave pool. It may be understood that the differences between microwave ovens and RF dryers arise from the differences between the implementation structures of applicator vs. magnetron/waveguide, which renders much of the microwave solutions inapplicable for RF dryers.

Each of the conductive cathode and anode elements 12, 14, 16, 18 remain at least partially spaced from each other by a separating gap, or by non-conductive segments, such as by the first and second support elements 20, 23, or by the optional air gap 70. The support elements 20, 23 may be made of any suitable low loss, fire retardant materials, or at least one layer of insulating materials that isolates the conductive cathode and anode elements 12, 14, 16, 18. The support elements 20, 23 may also provide a rigid structure for the laundry drying appliance 10, or may be further supported by secondary structural elements, such as a frame or truss system. The air gap 70 may provide enough separation to prevent arcing or other unintentional conduction, based on the electrical characteristics of the laundry drying appliance 10. Alternative embodiments are envisioned wherein the RF applicator 22 may be directly coupled to the respective second cathode and anode elements 14, 18.

Figure 2:
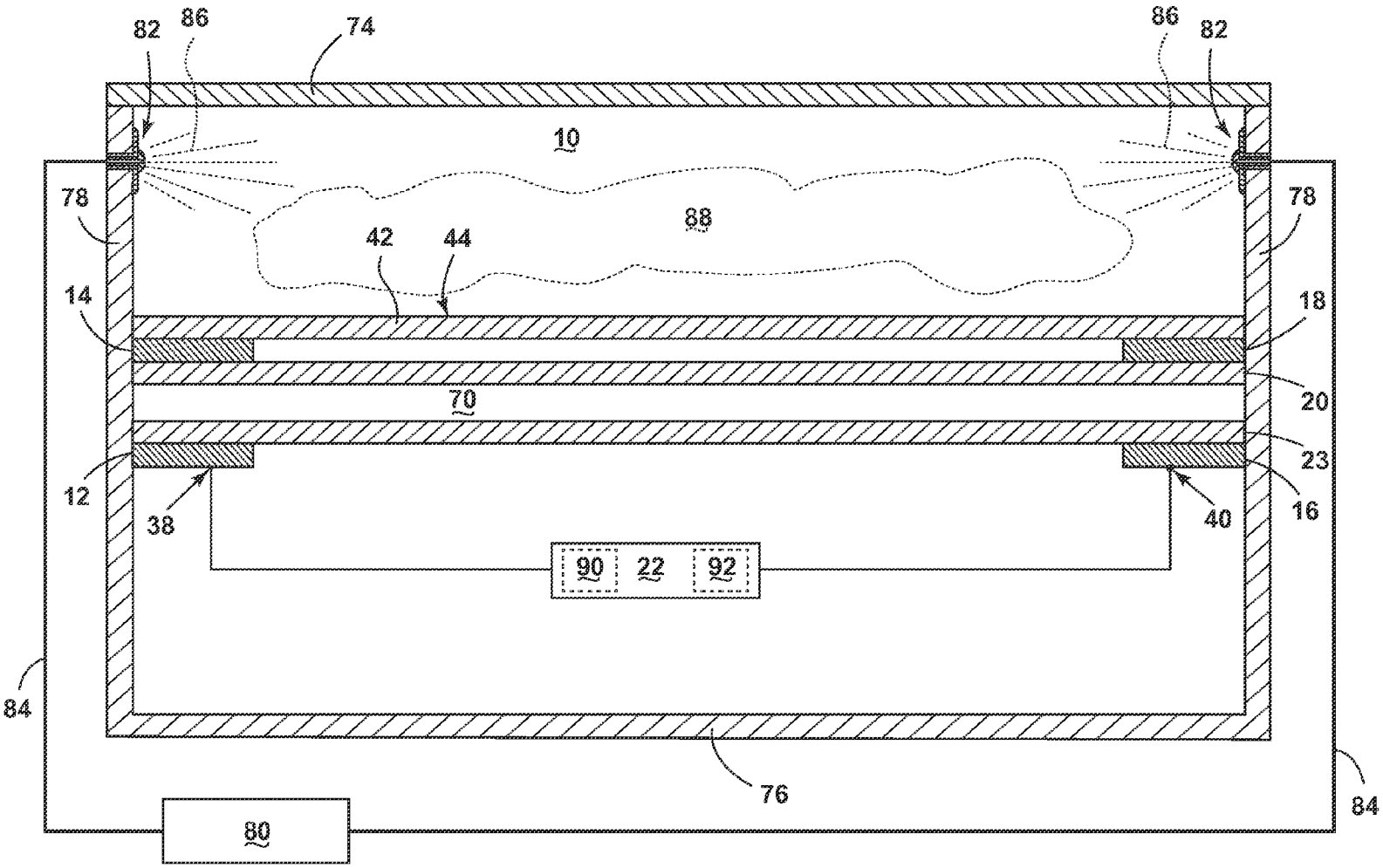
FIG. 2 is a partial sectional view taken along line 2-2 of FIG. 1 in accordance with the first embodiment of the invention.

Turning now to the partial sectional view of FIG. 2, taken along line 2-2 of FIG. 1 in accordance with the first embodiment of the invention, the first support element 20 may further include a non-conductive bed 42 wherein the bed 42 may be positioned above the interdigitally arranged pluralities of teeth 28, 34 (not shown in FIG. 2). The bed 42 further includes a substantially smooth and flat upper surface 44 for receiving wet laundry. The bed 42 may be made of any suitable low loss, fire retardant materials that isolate the conductive elements from the articles to be dehydrated.

FIG. 2 additionally illustrates a housing for the laundry drying appliance 10 comprising a top wall 74, bottom wall 76, and two sidewalls 78, and a water source 80. The laundry drying appliance 10 may be removably or fixedly coupled with the housing at any wall 74, 76, 78. At least one wall 74, 76, 78 may further include a water dispensing apparatus, such as a nozzle 82, coupled with the water source 80, for example, by tubing 84, and having a nozzle configured for dispensing water. For instance, as illustrated, each sidewall 78 include a nozzle 82 configured to mist 86 water onto an article of clothing 88. In another instance, the nozzles 82 may be positioned directly above, below, or perpendicular, relative to the article of clothing 88.

Alternative water dispensing apparatuses are envisioned to be configured to spray, drip, or pour liquid over the article or articles of clothing 88. The water dispensing apparatuses may be configured to move, alternate, or adjust their dispensing characteristics, such as pressure, in order to be able to selectively dispense the water across any portion of, or the entire portion of, the article of clothing 88. Alternatively, the dispensing apparatuses may be configured to move relative to the article of clothing 88, or the article of clothing 88 may be moveable relative to the dispensing apparatuses, for instance by moving the bed 42, in order to selectively dispense the water across any portion of, or the entire portion of, the article of clothing 88. Furthermore, while two nozzles 82 are illustrated, any number of water dispensing apparatuses may be used. For example, an array of independently-controllable water dispensing apparatuses are envisioned, wherein water may be dispensed only where needed.

The water source 80 may further include a water pump system for moving the water throughout the nozzle 82 and tubing 84 system, however alternate movement systems are envisioned. Additionally, the water source 80 may be provided within the housing of the laundry drying appliance 10, or may be provided via an external source. Alternate wall 74, 76, 78 configurations are envisioned for housing at least a portion of the laundry drying appliance 10. Moreover, while water may be described, the water source 80 may use tap water, distilled water, water-based aqueous solutions, scents, or many other types of liquid wherein application of the liquid to the article of clothing 88 changes the impedance of the article of clothing 88

The RF applicator 22 may further include a controller 90 coupled with the water source 80, and an impedance matching circuit 92. The controller 90 may be configured to operate the water source 80, and thus, dispense water from the source 80 to the article of clothing 88 via the nozzle 82. The impedance matching circuit 92 may be coupled with the controller 90, and may be coupled with additional sensors (not shown), and configured to provide the controller 90 impedance characteristics of the RF applicator 22 or the article of clothing 88. Examples of impedance characteristics of the RF applicator 22 include, but are not limited to, sensed, measured, or compared values relating to voltage, current, or e-field applied by the applicator 22. Examples of impedance characteristics of the article of clothing 88 include, but are not limited to, sensed, measured, or compared values relating to temperature, material composition, or wetness.

While the RF applicator 22 may be shown including the controller 90 and impedance matching circuit 92, alternate configurations are envisioned wherein either the controller 90 or and impedance matching circuit 92, or both the controller 90 or and impedance matching circuit 92 are separated from the RF applicator 22. In another instance, the controller 90 may further include the impedance matching circuit 92.

The aforementioned structure of the laundry drying appliance 10 operates by creating a first capacitive coupling between the first cathode element 12 and the second cathode element 14 separated by at least a portion of the at least one support element 20, 23, a second capacitive coupling between the first anode element 16 and the second anode element 18 separated by at least a portion of the at least one support element 20, 23, and a third capacitive coupling between the pluralities of teeth 28, 34 of the second cathode element 14 and the second anode element 18, at least partially spaced from each other. During drying operations, wet laundry to be dried may be placed on the upper surface 44 of the bed 42. During, for instance, a predetermined cycle of operation, the RF applicator 22 may be continuously or intermittently energized to generate an e-field between the first, second, and third capacitive couplings which interacts with liquid in the laundry. The liquid residing within the e-field will be dielectrically heated to effect a drying of the laundry.

During the drying of the laundry, the top wall 74 of the housing may be opened such that a wet article of clothing 88 may be placed on the bed 42 to be dried. When the e-field may be energized by the RF applicator 22, the equivalent resistance of the laundry increases as water may be dielectrically heated from the laundry. The result of the increased resistance produces a higher RF applicator 22 plate voltage applied at the second cathode and anode elements 14, 18. Furthermore, portions of the laundry may dry at different rates due to, for instance, the position of the laundry relative to the e-field or the relative wetness of different articles of clothing 88 or clothing 88 materials.

The controller 90, possibly in combination with the impedance matching circuit 92, senses, measures, and/or compares the one or more impedance characteristic of the RF applicator 22 and/or the laundry, and operates the water dispensing apparatus in response to an unbalanced impedance matching between the applicator 22 and the laundry. The controlled dispensing of the water onto the laundry affects the impedance of the laundry to effectively help match the impedance of the laundry to the impedance of the RF applicator 22. It may be envisioned that as used, the phrase "match the impedance", as well as similar phrases, may be used to describe a process by which the impedance may be changed to reduce the difference or disparity between two impedances, and may not denote a process resulting with the two impedances being equal.

For instance, when the plate voltage or equivalent resistance of the laundry increases past a predetermined threshold, indicative of an unmatched impedance, the RF applicator 22 may discontinue energizing the e-field while the controller 90 operates the water source 80 to dispense mist 86 from the nozzle 82 to the article of clothing 88 until the sensed, measured, or estimated impedance of the clothing 88 changes to help match the impedance of the applicator 22. Stated another way, if the mismatch between the impedance of the clothing 88 and the impedance of the RF applicator 22 is too great, the RF applicator 22 power must be reduced to avoid generating too much heat in the applicator 22. Adding water helps change the impedance of the clothing 88 making it more lossy, and thus helping match the impedance of the RF applicator 22.

Alternate embodiments are envisioned wherein the RF applicator 22 continues to energize the e-field, or intermittently energizes the e-field while the controller 90 operates the water dispensing apparatus. Additionally, it may be envisioned that the controller operates the water dispensing apparatus in response to other measurements, for instance, in response to a timer or a manually selected value, such as a drying cycle or material composition. In yet another envisioned embodiment, the liquid may be dispensed to the laundry only where needed, for instance by operating a subset of an array of nozzles 82, or by moving a movable nozzle 82, in response to a specifically located unbalance of impedances between the RF applicator 22 and the laundry.

Many other possible configurations in addition to that shown in the above figures are contemplated by the present embodiment. For example, one embodiment of the invention contemplates different geometric shapes for the laundry drying appliance 10, such as substantially longer, rectangular appliance 10 where the cathode and anode elements 12, 14, 16, 18 are elongated along the length of the appliance 10, or the longer appliance 10 includes a plurality of cathode and anode element 12, 14, 16, 18 sets. In such a configuration, the upper surface 44 of the bed 42 may be smooth and slightly sloped to allow for the movement of wet laundry or water across the laundry drying appliance 10, wherein the one or more cathode and anode element 12, 14, 16, 18 sets may be energized individually or in combination by one or more RF applicators 22 to dry the laundry as it traverses the appliance 10. Alternatively, the bed 42 may be mechanically configured to move across the elongated laundry drying appliance 10 in a conveyor belt operation, wherein the one or more cathode and anode element 12, 14, 16, 18 sets may be energized individually or in combination by one or more RF applicators 22 to dry the laundry as it traverses the appliance 10. Additionally, an embodiment is envisioned wherein the cathode and anode elements 12, 14, 16, 18 are arranged in a substantially vertical, as opposed to horizontal, configuration such that laundry or textiles may be dried by the e-field, for instance, while suspended or hanging.

Additionally, a configuration may be envisioned wherein only a single support element 20 separates the first cathode and anode elements 12, 16 from their respective second cathode and anode elements 14, 18. This configuration may or may not include the optional air gap 70. In another embodiment, the first cathode element 12, first anode element 16, or both elements 12, 16 may be positioned on the opposing side of the second support element 23, within the air gap 70. In this embodiment, the air gap 70 may still separate the elements 12, 16 from the first support element 20, or the elements 12, 16 may be in communication with the first support element 20.

Figure 3:
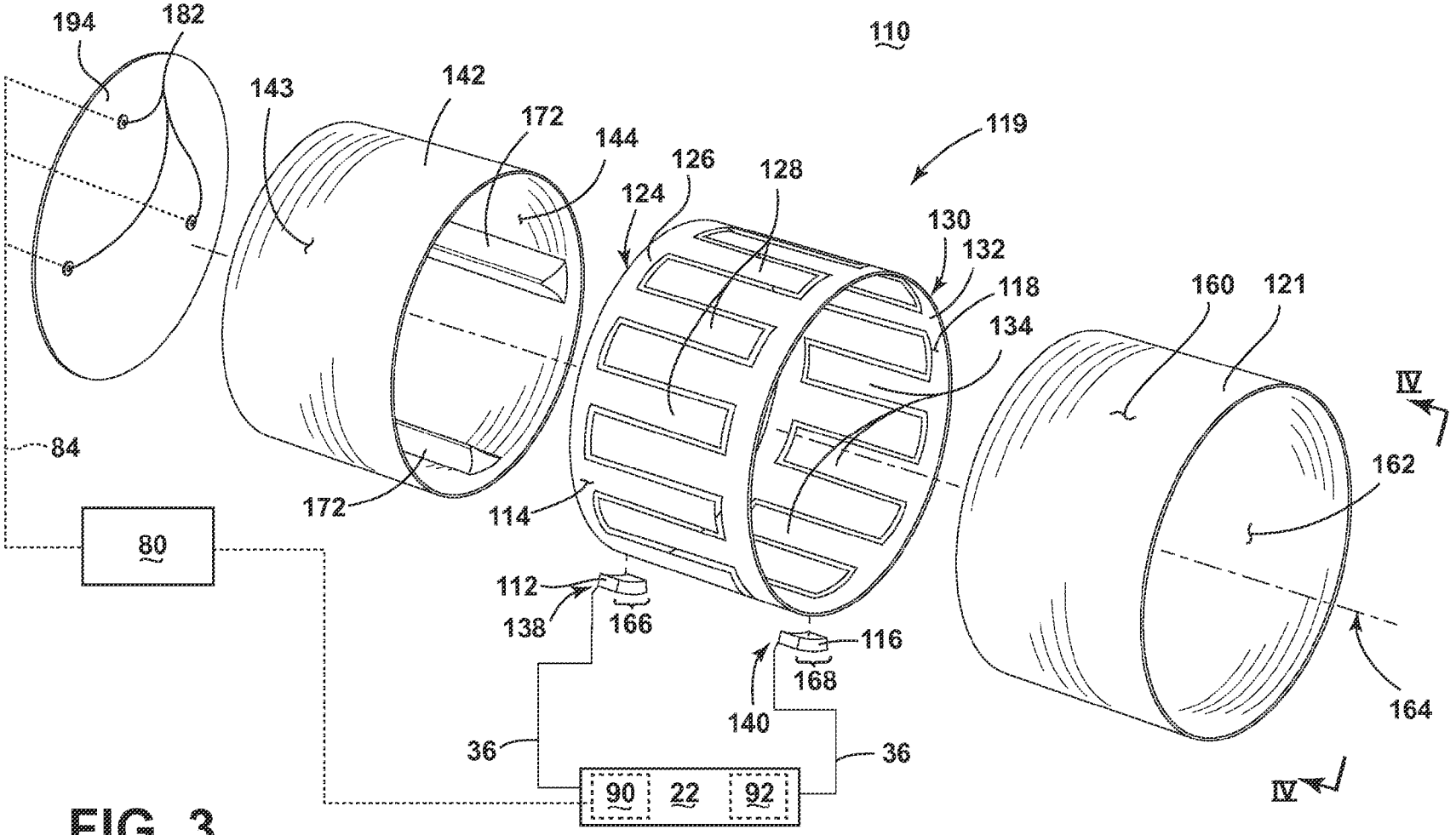
FIG. 3 is a schematic perspective view of an axially-exploded laundry drying appliance with a rotating drum configuration, in accordance with the second embodiment of the invention.

Furthermore, FIG. 3 illustrates an alternative laundry drying appliance 110 according to a second embodiment of the invention. The second embodiment may be similar to the first embodiment; therefore, like parts will be identified with like numerals increased by 100, with it being understood that the description of the like parts of the first embodiment applies to the second embodiment, unless otherwise noted. A difference between the first embodiment and the second embodiment may be that laundry drying appliance 110 may be arranged in a drum-shaped configuration rotatable about a rotational axis 164, instead of the substantially flat configuration of the first embodiment.

In this embodiment, the support element includes a drum 119 having a non-conducting outer drum 121 having an outer surface 160 and an inner surface 162, and may further include a non-conductive element, such as a sleeve 142. The sleeve 142 further includes an inner surface 144 for receiving and supporting wet laundry. The inner surface 144 of the sleeve 142 may further include optional tumble elements 172, for example, baffles, to enable or prevent movement of laundry. The sleeve 142 and outer drum 121 may be made of any suitable low loss, fire retardant materials that isolate the conductive elements from the articles to be dehydrated. While a sleeve 142 is illustrated, other non-conductive elements are envisioned, such as one or more segments of non-conductive elements, or alternate geometric shapes of non-conductive elements.

This embodiment further includes a non-rotating terminating plate 194 at one end of the drum 119, wherein, when assembled, the plate 194 terminates the cavity of the drum 119. The terminating plate 194 further includes at least one water dispensing apparatus, such as a nozzle 182. Although three dispersed nozzles 182 are shown, alternate placement and numbers of nozzles are envisioned. Additionally, each nozzle 182 may be individually controllable. Alternate embodiments are envisioned wherein the terminating plate 194 may be coupled with, and/or rotates with, the drum 119. In a rotating embodiment, the terminating plate 194 and/or the nozzles 182 are configured such that they dispense liquid from the water source 80 continuously or intermitted, either during rotation or after rotation has ceased.

As illustrated, the conductive second cathode element 114, and the second anode elements 118 are similarly arranged in a drum configuration and fixedly mounted to the outer surface 143 of the sleeve 142. In this embodiment, the opposing first and second comb elements 124, 130 include respective first and second bases 126, 132 encircling the rotational axis 164, and respective first and second pluralities of teeth 128, 134, interdigitally arranged about the rotational axis 164.

The laundry drying appliance 110 further includes a conductive first cathode element comprising at least a partial cathode ring 112 encircling a first radial segment 166 of the drum 119 and an axially spaced opposing conductive first anode element comprising at least a partial anode ring 116 encircling a second radial segment 168 of the drum 119, which may be different from the first radial segment 166. As shown, at least a portion of the drum 119 separates the at least partially axially-aligned cathode ring 112 and the first base 126 portion of the second cathode elements 114. Similarly, at least a portion of the drum 119 separates the at least partially axially-aligned anode ring 116 and the second base 132 portion of the second anode element 118. Additionally, this configuration aligns the first base 126 with the first radial segment 166, and the second base 132 with the second radial segment 168. Alternate configurations are envisioned where only at least a portion of the drum 119 separates the cathode or anode rings 112, 116 from their respective first and second bases 126, 132.

The RF applicator 22 may be configured to generate a field of electromagnetic radiation (e-field) within the radio frequency spectrum between outputs electrodes and may be electrically coupled between the cathode ring 112 and the anode ring 116 by conductors 36 connected to at least one respective cathode and anode ring contact point 138, 140.

Each of the conductive cathode and anode elements 112, 114, 116, 118 remain at least partially spaced from each other by a separating gap, or by non-conductive segments, such as by the outer drum 121. The outer drum 121 may be made of any suitable low loss, fire retardant materials, or at least one layer of insulating materials that isolates the conductive cathode and anode elements 112, 114, 116, 118. The drum 119 may also provide a rigid structure for the laundry drying appliance 110, or may be further supported by secondary structural elements, such as a frame or truss system.

Figure 4:
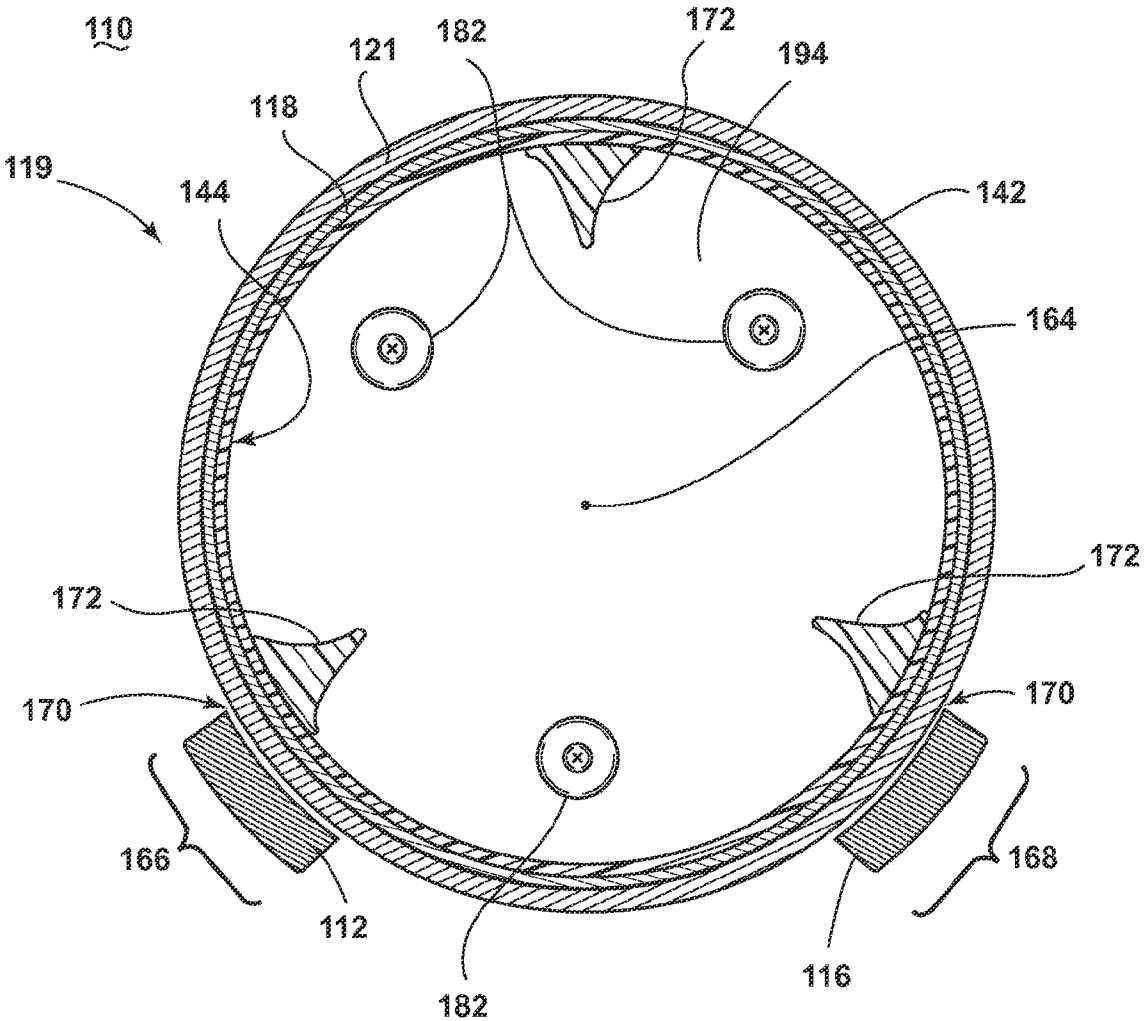
FIG. 4 is a partial sectional view taken along line 4-4 of FIG. 3 showing the assembled configuration of the drum and anode/cathode elements, in accordance with the second embodiment of the invention.

As shown in FIG. 4, the assembled laundry drying appliance 110, according to the second embodiment of the invention, creates a substantially radial integration between the sleeve 142, second cathode and anode elements 114, 118 (cathode element not shown), and drum 119 elements. It may be envisioned that additional layers may be interleaved between the illustrated elements. Additionally, while the cathode ring 112 and anode ring 116 are shown offset about the rotational axis for illustrative purposes, alternate placement of each ring 112, 116 may be envisioned.

The second embodiment of the laundry drying appliance 110 operates by creating a first capacitive coupling between the cathode ring 112 and the second cathode element 114 separated by at least a portion of the drum 119, a second capacitive coupling between the anode ring 116 and the second anode element 118 separated by at least a portion of the drum 119, and a third capacitive coupling between the pluralities of teeth 128, 134 of the second cathode element 114 and the second anode element 118, at least partially spaced from each other.

During drying operations, wet laundry to be dried may be placed on the inner surface 144 of the sleeve 142. During a cycle of operation, the drum 119 may rotate about the rotational axis 164 at a speed at which the tumble elements 172 may enable, for example, a folding or sliding motion of the laundry articles. During rotation, the RF applicator 22 may be off, or may be continuously or intermittently energized to generate an e-field between the first, second, and third capacitive couplings which interacts with liquid in the laundry. The liquid interacting with the e-field located within the inner surface 144 will be dielectrically heated to effect a drying of the laundry. Operation of the water source 80, controller 90, and nozzles 182 are substantially similar to the first embodiment.

Many other possible configurations in addition to that shown in the above figures are contemplated by the present embodiment. For example, in another configuration, the RF applicator 22 may be directly connected to the respective second cathode and anode elements 114, 118. In another configuration, the cathode and anode rings 112, 116 may encircle larger or smaller radial segments, or may completely encircle the drum 119 at first and second radial segments 166, 168, as opposed to just partially encircling the drum 119 at a first and second radial segments 166, 168. In yet another configuration, the first and second bases 126 and 132 and the first and second plurality of teeth 128, 134 may only partially encircle the drum 119 as opposed to completely encircling the drum 119. In even another configuration, the pluralities of teeth 28, 34, 128, 134 may be supported by slotted depressions in the support element 20 or sleeve 142 matching the teeth 28, 34, 128, 134 for improved dielectric, heating, or manufacturing characteristics of the appliance. In another configuration, the second cathode and anode elements 114, 118 may only partially extend along the outer surface 143 of the sleeve 142.

In an alternate operation of the second embodiment, the RF applicator 22 may be intermittently energized to generate an e-field between the first, second, and third capacitive couplings, wherein the intermittent energizing may be related to the rotation of the drum 119, or may be timed to correspond with one of aligned capacitive couplings, tumbling of the laundry, or power requirements of the laundry drying appliance 110. In another alternate operation of the second embodiment, the RF applicator 22 may be moving during the continuous or intermittent energizing of the e-field between the first, second, and third capacitive couplings. For instance, the RF applicator 22 may rotate about the rotational axis 164 at similar or dissimilar periods and directions as the drum 119. In yet another alternate operation of the second embodiment, the drum may be rotationally stopped or rotationally slowed while the RF applicator 22 continuously or intermittently energizes to generate an e-field between the first, second, and third capacitive couplings.

Figure 5:
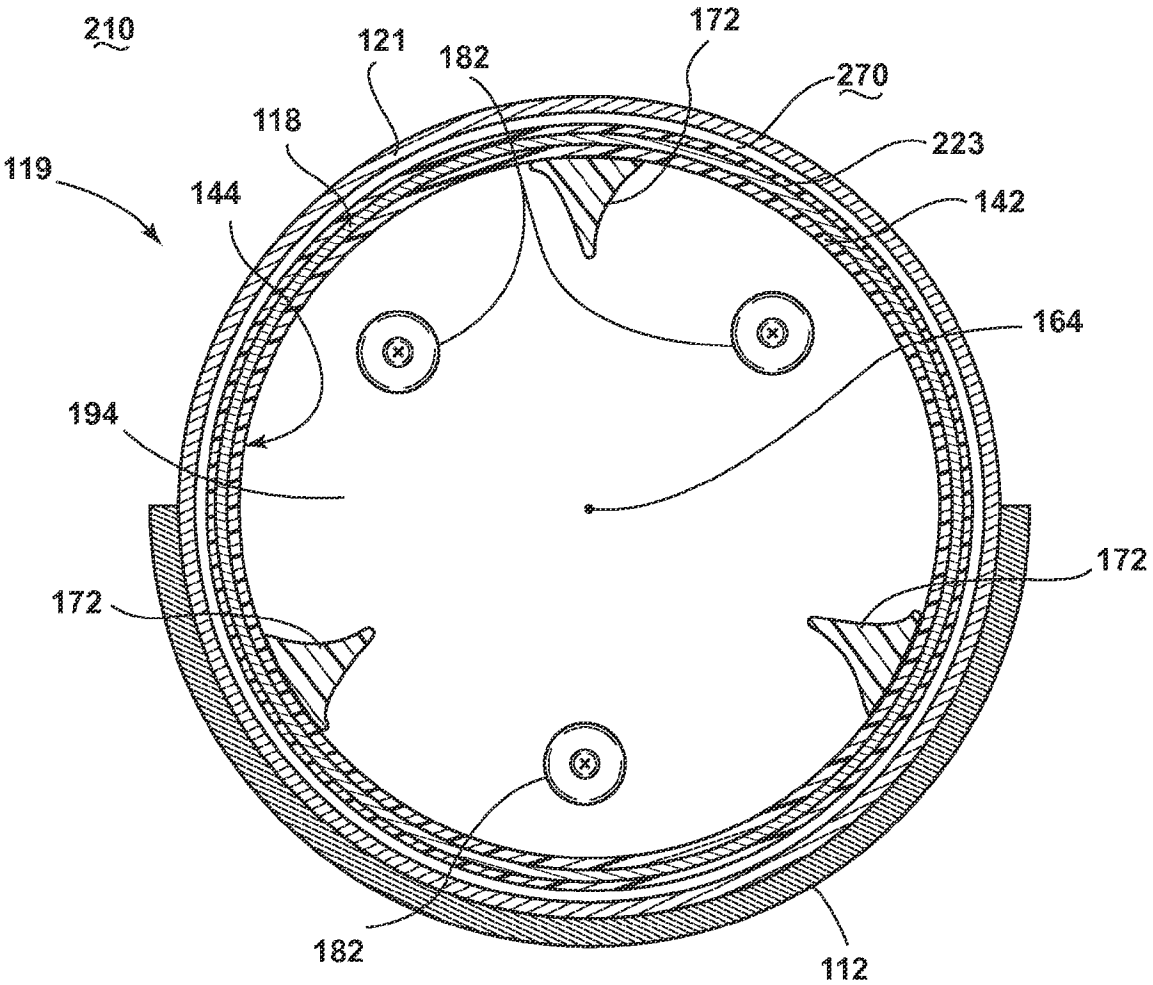
FIG. 5 is a partial sectional view showing an alternate assembled configuration of the drum and anode/cathode elements, in accordance with the third embodiment of the invention.

FIG. 5 illustrates an alternative assembled laundry drying appliance 210, according to the third embodiment of the invention. The third embodiment may be similar to the first and second embodiments; therefore, like parts will be identified with like numerals increased by 200, with it being understood that the description of the like parts of the first and second embodiment applies to the third embodiment, unless otherwise noted. A difference between the first embodiment and the second embodiment may be that laundry drying appliance 210 may be arranged in a drum-shaped configuration, wherein the outer drum 121 may be separated from the second anode element 118 by a second drum element 223 and an air gap 270.

Additionally, the same anode ring 116 and cathode ring 112 (not shown) are elongated about a larger radial segment of the drum 119. Alternatively, the cathode ring 112, anode ring 116, or both rings 112, 116 may be positioned on the opposing side of the outer drum 121, within the air gap 270. In this embodiment, the air gap 270 may still separate the elements 112, 116 from the second drum element 223, or the elements 112, 116 may be in communication with the second drum element 223. The operation of the third embodiment may be similar to that of the second embodiment.

Figure 6:
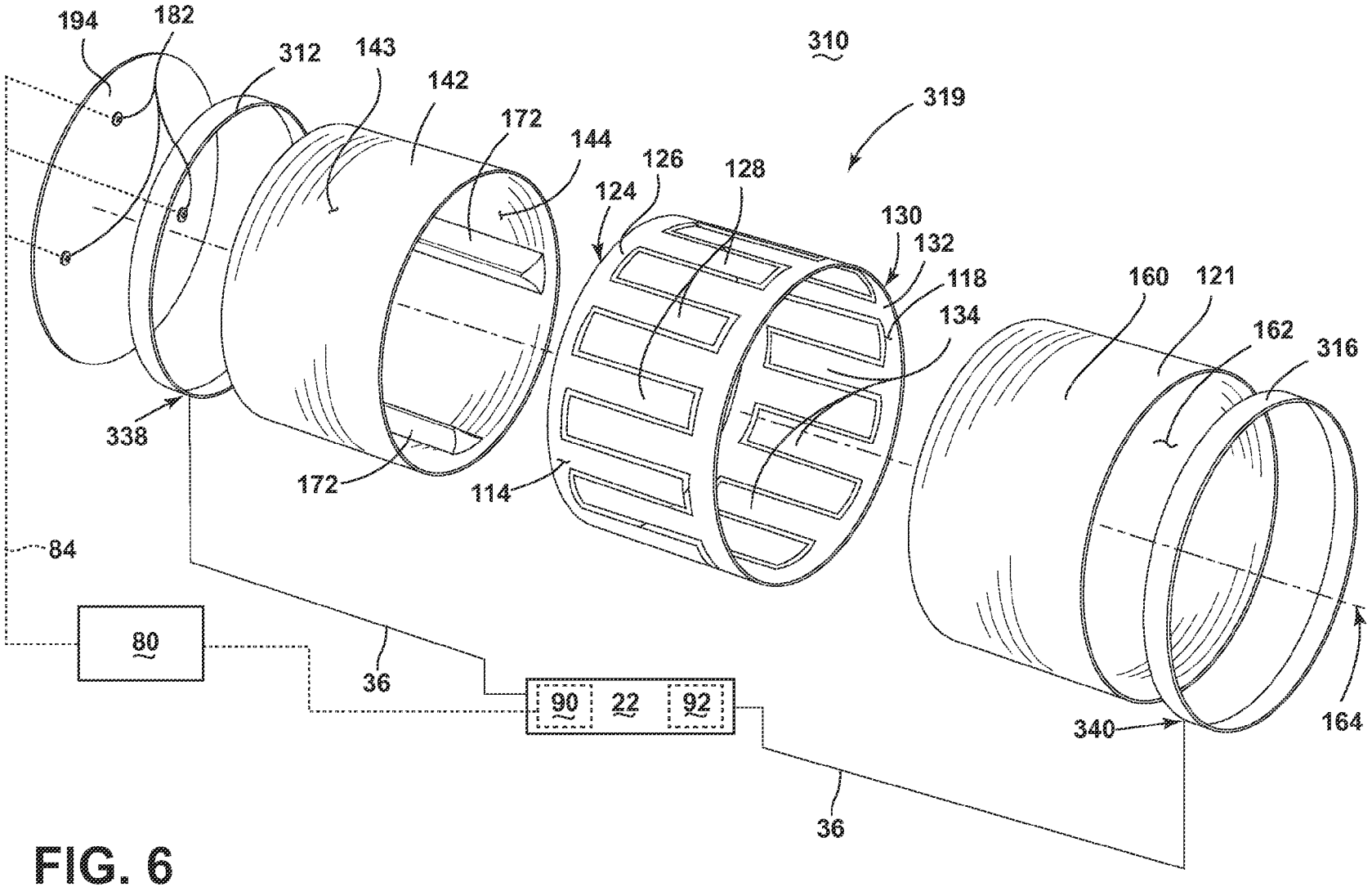
FIG. 6 is a schematic perspective view of an axially-exploded laundry drying appliance with a rotating drum configuration having integrated anode/cathode rings, in accordance with the fourth embodiment of the invention.

FIG. 6 illustrates an alternative laundry drying appliance 310 according to a fourth embodiment of the invention. The fourth embodiment may be similar to the second or third embodiments; therefore, like parts will be identified with like numerals beginning with 300, with it being understood that the description of the like parts of the first, second, and third embodiments apply to the fourth embodiment, unless otherwise noted. A difference between the prior embodiments and the fourth embodiment may be that first cathode and anode elements include cathode and anode rings 312, 316 assembled at axially opposite ends of the drum 319. This configuration may be placed within a housing, for instance, a household dryer cabinet (not shown).

In this embodiment, the assembled cathode and anode rings 312, 316 are electrically isolated by, for example, at least a portion of the drum 319 or air gap (not shown). In this sense, the laundry drying appliance 310 retains the first and second capacitive couplings of the second embodiment.

The RF applicator 22 may be configured to generate a field of electromagnetic radiation (e-field) within the radio frequency spectrum between outputs electrodes and may be electrically coupled between the cathode ring 312 and the anode ring 316 by conductors 36 connected to at least one respective cathode and anode ring contact point 338, 340. In this embodiment, the cathode and anode ring contact points 338, 340 may further include direct conductive coupling through additional components of the dryer cabinet supporting the rotating drum 319, such as via ball bearings (not shown). Other direct conductive coupling through additional components of the dryer cabinet may be envisioned.

The fourth embodiment of the laundry drying appliance 310 operates by creating a first capacitive coupling between the cathode ring 312 and the second cathode element 114 separated by at least a portion of the drum 319 or air gap, a second capacitive coupling between the anode ring 316 and the second anode element 118 separated by at least a portion of the drum 319 or air gap. During rotation, the RF applicator 22 may be off, or may be continuously or intermittently energized to generate an e-field between the first, second, and third capacitive couplings which interacts with liquid in the laundry. The liquid interacting with the e-field located within the inner surface 144 will be dielectrically heated to effect a drying of the laundry.

Figure 7:
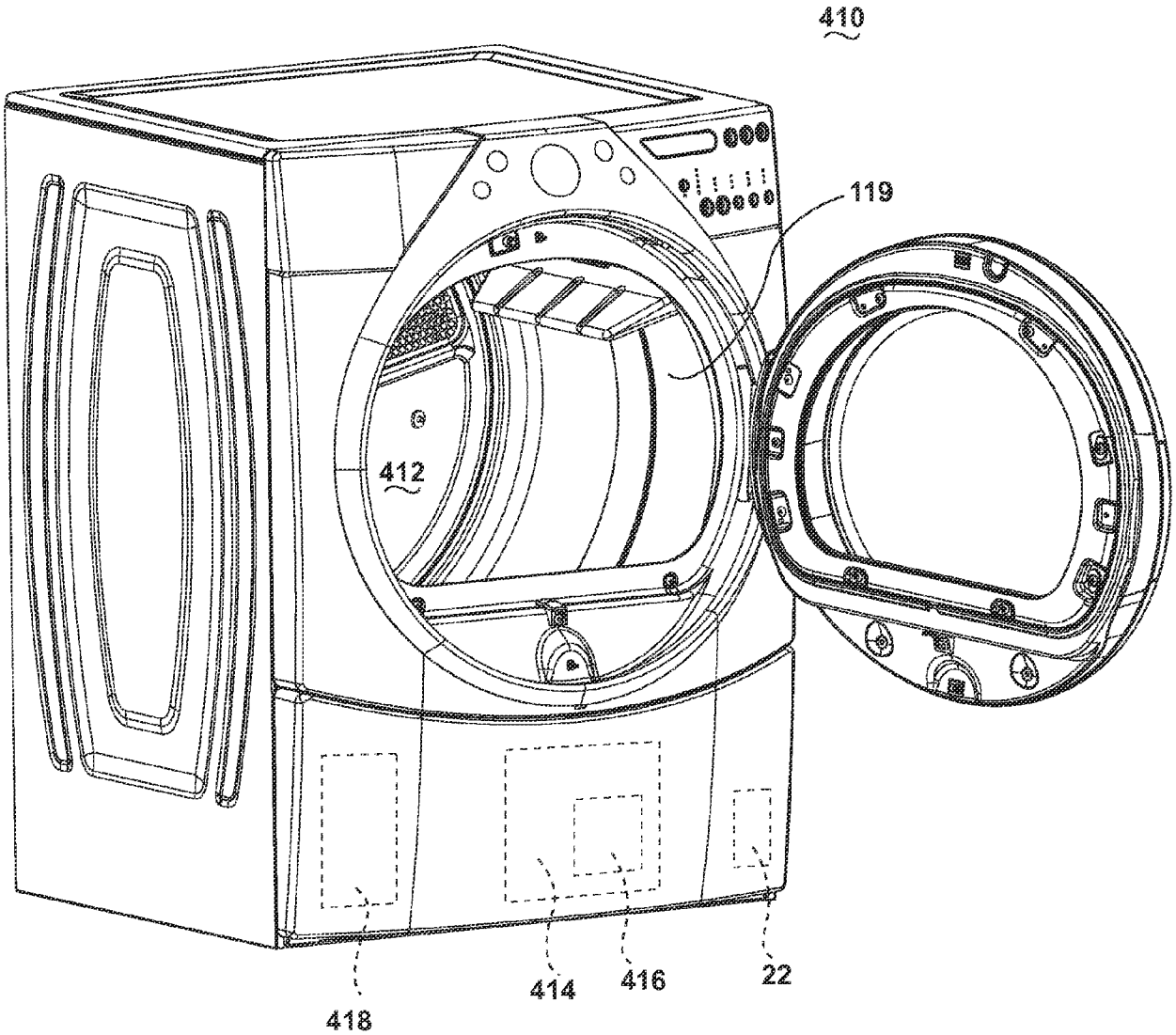
FIG. 7 is a schematic perspective view of an embodiment where the laundry drying appliance is shown as a clothes dryer incorporating the drum of the second, third, and fourth embodiments.

FIG. 7 illustrates an embodiment where the appliance may be a laundry drying appliance, such as a clothes dryer 410, incorporating the drum 119, 219, 319 (illustrated as drum 119), which defines a drying chamber 412 for receiving laundry for treatment, such as drying. The clothes dryer includes an air system 414 supplying and exhausting air from the drying chamber 412, which includes a blower 416. A heating system 418 may be provided for hybrid heating the air supplied by the air system 414, such that the heated air may be used in addition to the dielectric heating. The heating system 418 may work in cooperation with the laundry drying appliance 110, as described herein.

Many other possible embodiments and configurations in addition to those shown in the above figures are contemplated by the present disclosure. For example, alternate geometric configurations of the first and second pluralities of teeth are envisioned wherein the interleaving of the teeth are designed to provide optimal electromagnetic coupling while keeping their physical size to a minimum. Additionally, the spacing between the pluralities of teeth may be larger or smaller than illustrated. Additionally, the liquid may be cycled through the components of the RF applicator 22 to absorb heat, and thus cool the RF applicator 22 components (not shown). The RF applicator 22 liquid may then be dispensed to the laundry as described above.

The embodiments disclosed herein provide a laundry drying appliance using an RF applicator to dielectrically heat liquid in wet articles, and apply liquid, when needed, to effectively help match impedances between the RF applicator and the laundry to effect a drying of the articles. One advantage that may be realized in the above embodiments may be that the above described embodiments are able to effectively match impedances between the article or articles of clothing and the RF applicator. By applying liquid to the laundry, the laundry drying appliance lowers the equivalent resistance of the laundry, and thus more closely matching the impedance of the RF applicator. Consequently, the RF applicator may not be required to apply a higher plate voltage to the anode and cathode elements, associated with the higher laundry resistance, and RF applicator power levels may be maintained to dry the laundry, without excess heat being generated in the applicator (which may be associated with unbalanced impedances).

Another advantage of the above described embodiments may be that since the RF applicator does not have to reduce power levels because of RF applicator heat generation or high plate voltage levels, the overall drying process may complete faster. Moreover, due to the impedance matching, high power levels, and lower plate voltage, there may be less of a danger of voltage arcing across the capacitive couplings.

Yet another advantage of the above described embodiments may be that the laundry may be more likely to dry evenly. In the typical RF drying application, the dielectric heating evaporates the liquid on the outer layers of the laundry before the inner layers are dried. The above described embodiments allow for re-wetting of the outer layers of the laundry such that the inner and outer layers of the laundry dry more evenly, and at a closer drying rate.

In yet another advantage, the above described embodiments allows for the possibility of using widely-available liquid sources, such as tap water, or specialized liquid sources, such as liquid with a scent, which may provide additional benefits such as consumer preferences, or perceived freshness, etc. Additionally, the design of the water dispensing apparatuses may be controlled to allow for individual dispensing of liquid at particular laundry locations, or where dispensing may be needed most to continue drying applications.

A further advantage that may be realized in the above embodiments may be that the above described embodiments are able to dry articles of clothing during rotational or stationary activity, allowing the most efficient e-field to be applied to the clothing for particular cycles or clothing characteristics. A further advantage of the above embodiments may be that the above embodiments allow for selective energizing of the RF applicator according to such additional design considerations as efficiency or power consumption during operation.

Additionally, the design of the anode and cathode may be controlled to allow for individual energizing of particular RF applicators in a single or multi-applicator embodiment. The effect of individual energization of particular RF applicators results in avoiding anode/cathode pairs that would result in no additional material drying (if energized), reducing the unwanted impedance of additional anode/cathode pairs and electromagnetic fields inside the drum, and an overall reduction to energy costs of a drying cycle of operation due to increased efficiencies. Finally, reducing unwanted fields will help reduce undesirable coupling of energy into isolation materials between capacitive coupled regions.

Moreover, the capacitive couplings in embodiments of the invention allow the drying operations to move or rotate freely without the need for physical connections between the RF applicator and the pluralities of teeth. Due to the lack of physical connections, there will be fewer mechanical couplings to moving or rotating embodiments of the invention, and thus, an increased reliability appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A laundry drying appliance to dry an article, comprising:

a support element for supporting the article to be dried;

an anode element capacitively coupled with a cathode element and positioned relative to the support element to create a field of electromagnetic radiation (e-field) on the support element;

a radio frequency (RF) applicator coupled with the anode element and the cathode element and operable to energize the anode element and the cathode element to generate an e-field in the radio frequency spectrum operable to dielectrically heat liquid within the article on the support element;

a water dispensing apparatus coupled with a water source; and a controller configured to operate the water dispensing apparatus by dispensing water from the water source to the article in controlled amounts to effectively match an impedance of the article to an impedance of the RF applicator while the e-field is generated.

2. The laundry treating appliance of claim 1 wherein the water dispensing apparatus further comprises an array of water dispensers.

3. The laundry treating appliance of claim 2 wherein the array of water dispensers are independently controllable.

4. The laundry treating appliance of claim 1 wherein the water dispensing apparatus further comprises a misting nozzle.

5. The laundry treating appliance of claim 1 wherein the water dispensing apparatus is located at least one of above, below, and perpendicular, relative to the article.

6. The laundry treating appliance of claim 1 wherein the water source further comprises at least one of water, an aqueous solution, and scented water.

7. The laundry treating appliance of claim 1, further comprising an impedance matching circuit wherein the impedance matching circuit operably controls the water dispensing apparatus in response to at least one of a sensed value, selected value, timer, temperature, voltage, e-field, and article material.

8. The laundry treating appliance of claim 1 wherein the support element comprises a bed, with the laundry supported on an upper surface of the bed.

9. The laundry treating appliance of claim 1 wherein the support element comprises a drum, rotatable about a rotational axis, with inner and outer surfaces, and the laundry is supported on the inner surface.

* * * * *